US010870519B2

(12) United States Patent
Lotfi et al.

(10) Patent No.: US 10,870,519 B2
(45) Date of Patent: Dec. 22, 2020

(54) TAMPER EVIDENT CONTAINERS

(71) Applicants: Ali Lotfi, Weston, MA (US); Lawrence E. Jewett, Uxbridge, MA (US)

(72) Inventors: Ali Lotfi, Weston, MA (US); Lawrence E. Jewett, Uxbridge, MA (US)

(73) Assignee: LACERTA GROUP, INC, Mansfield, MA (US)

( * ) Notice: Subject to any disclaimer, the term of this patent is extended or adjusted under 35 U.S.C. 154(b) by 0 days.

(21) Appl. No.: 14/872,106

(22) Filed: Sep. 30, 2015

(65) Prior Publication Data

US 2016/0096663 A1 Apr. 7, 2016

Related U.S. Application Data

(60) Provisional application No. 62/058,092, filed on Sep. 30, 2014.

(51) Int. Cl.

*B65D 43/02* (2006.01)
*B65D 17/00* (2006.01)
*B65D 43/06* (2006.01)

(52) U.S. Cl.

CPC ..... *B65D 43/0239* (2013.01); *B65D 17/04* (2013.01); *B65D 17/06* (2013.01); *B65D 43/0235* (2013.01); *B65D 43/06* (2013.01); *B65D 2401/15* (2020.05); *B65D 2401/60* (2020.05); *B65D 2543/00101* (2013.01); *B65D 2543/00453* (2013.01); *B65D 2543/00842* (2013.01)

(58) Field of Classification Search

CPC .... B65D 43/0239; B65D 17/04; B65D 17/06; B65D 43/026; B65D 43/0241; B65D 2543/00324; B65D 43/162

USPC ..... 220/6, 265; 215/254

See application file for complete search history.

(56) References Cited

U.S. PATENT DOCUMENTS

| | | | | |
|---|---|---|---|---|
| 2,915,214 | A * | 12/1959 | Frankel | B65D 75/22 220/266 |
| 2,998,158 | A * | 8/1961 | Tupper | B65D 43/0254 220/276 |
| 3,572,579 | A * | 3/1971 | Mueller | B65D 43/027 206/807 |
| 5,040,695 | A | 8/1991 | Adams et al. | |
| 5,094,357 | A | 3/1992 | McKinney | |
| 5,938,068 | A * | 8/1999 | Atkins | B65D 75/22 220/266 |
| 6,254,139 | B1 | 7/2001 | Fresnel | |
| 7,021,482 | B2 * | 4/2006 | Solowiejko | B65D 21/022 220/254.2 |

(Continued)

FOREIGN PATENT DOCUMENTS

| | | |
|---|---|---|
| DE | 7816353 | 11/1978 |

*Primary Examiner* — Andrew T Kirsch

(74) *Attorney, Agent, or Firm* — JWIP & Patent Services, LLC; Jacob G. Weintraub, Esq.

(57) ABSTRACT

The present invention is directed to containers and packaging that incorporate novel tamper evident features. In particular, the containers of the present invention comprise newly designed tamper evident linkages, i.e., wedged fracture tabs. In addition, the present invention provides novel methods of improving tamper security of packages or containers by incorporating distinguishing printed graphics on the tamper evident component (e.g., frangible hinge, frangible tear strip, or wedged fracture tabs) of the present invention.

16 Claims, 9 Drawing Sheets

(56) References Cited

U.S. PATENT DOCUMENTS

| | | | | |
|---|---|---|---|---|
| 7,073,680 | B2 | 7/2006 | Boback et al. | |
| D585,735 | S | 2/2009 | Vovan et al. | |
| D587,993 | S | 3/2009 | Vovan | |
| 7,568,589 | B2 | 8/2009 | Vovan | |
| 7,631,776 | B2 | 12/2009 | Vovan et al. | |
| 7,712,626 | B2 | 5/2010 | Vovan | |
| 7,913,870 | B2 | 3/2011 | Vovan | |
| D646,563 | S | 10/2011 | Bontrager et al. | |
| 8,028,851 | B2 | 10/2011 | Vovan et al. | |
| 8,083,089 | B2 | 12/2011 | Vovan | |
| 8,123,064 | B2 | 2/2012 | Vovan | |
| 8,186,531 | B2 | 5/2012 | Parikh et al. | |
| 8,251,242 | B2 | 8/2012 | Vovan | |
| 8,251,249 | B1 | 8/2012 | Vovan | |
| 8,322,555 | B2 | 12/2012 | Chen | |
| 8,371,468 | B2 | 2/2013 | Sellari et al. | |
| 8,584,887 | B2 | 11/2013 | Segal | |
| 8,608,008 | B2 | 12/2013 | Gingras et al. | |
| 8,617,673 | B1 | 12/2013 | Desai et al. | |
| D698,241 | S | 1/2014 | Fosse | |
| 2004/0026430 | A1* | 2/2004 | Baker | B65D 1/36 220/575 |
| 2005/0017007 | A1 | 1/2005 | Sellari et al. | |
| 2008/0308557 | A1 | 12/2008 | Kyle et al. | |
| 2009/0223619 | A1 | 9/2009 | Vovan | |
| 2010/0072217 | A1 | 3/2010 | Parikh et al. | |
| 2010/0102074 | A1 | 4/2010 | Parikh et al. | |
| 2013/0043247 | A1* | 2/2013 | Nikaein | B65D 43/0249 220/265 |
| 2014/0224803 | A1 | 8/2014 | Pickering | |
| 2015/0083725 | A1* | 3/2015 | Sinha | B65D 43/0272 220/265 |

* cited by examiner

TAMPER EVIDENT CONTAINERS

RELATED APPLICATIONS

This application claims priority to U.S. Provisional Patent Application No. 62/058,092, filed on Sep. 30, 2014; the entirety of which is incorporated herein by reference.

BACKGROUND OF THE INVENTION

Consumers of products that are stored in their containers for repeated access generally prefer reclosable packages, particularly for comestible products, in order to reduce deterioration of the product. Moreover, disposable containers have become increasingly prevalent in today's commercial atmosphere to satisfy this demand. However, in certain product lines, evidence of product integrity for both merchants and their customers is critical for confidence in the product quality.

Such assurance of integrity, quality, and lack of tampering has been addressed in the past using a number of different "break-away" approaches where components that are broken to open the package cannot be reattached; such as through total package wrapping, partial package wrapping (e.g., plastic wrap around the edge of the cover), or through varying sizes of seals, tapes, or labels that may be broken to access the packaged goods. Recent advances in plastic thermoform technology have afforded access to packages that contain tear lines and tear strips created by scoring or perforating the plastic, which have provided increased ability for convenient visual inspection of packages of goods that are intended to be tamper evident.

As consumers generally gravitate towards packages that are easier to visually inspect for tampering prior to purchase, tear strips have been favored over tear lines for the fact that a tangible thin strip must be removed before the package can be opened; and thus the presence of an attached tear strip easily confirms the integrity of a product. Limitations of these products, however, relate to their hinged design, wherein the hinge of the cover with the base in each of these designs falls on a perforation that is by design, structurally weakened, increasing the chances that the supplier of the goods that fills the container may inadvertently fracture the hinge. Furthermore, the thin nature and typically awkward location of the tear strip makes grabbing onto and removing the strip less consumer friendly.

As such, there is a need for new tamper evident packages that address these concerns, as well as methods of improving tamper security of packages, e.g., of consumer goods.

SUMMARY OF THE INVENTION

Accordingly, the present invention is directed to containers and packaging that incorporate novel tamper evident features. In particular, the containers of the present invention comprise newly designed tamper evident linkages, i.e., wedged fracture tabs. Additionally, the present invention provides novel methods of improving tamper security of packages or containers by incorporating distinguishing printed graphics on the tamper evident component (e.g., frangible hinge, frangible tear strip, or wedged fracture tabs of the present invention).

As such, one aspect of the invention provides a tamper evident container comprising a cover portion comprising a peripheral locking flange assembly; a base portion comprising an upper peripheral sealing edge configured to substantially eliminate access to the peripheral locking flange assembly of the cover portion when the container is in the closed position; and a tamper evident linkage structure connecting the cover portion to the base portion comprising a wedged fracture tab (WFT), e.g., with an integrated non-frangible hinge. The WFT may be configured to produce access flaps upon full fracture and removal of the tab from the cover and base portions of the container.

Another aspect of the invention provides a tamper evident container comprising a cover portion comprising a peripheral locking flange assembly, wherein the peripheral locking flange assembly comprises a truncated recessed flange (TRF); a base portion comprising an upper peripheral sealing edge configured to substantially eliminate access to the peripheral locking flange assembly of the cover portion when the container is in the closed position; and a tamper evident linkage structure connecting the cover portion to the base portion comprising an asymmetrically frangible wedged fracture tab (WFT), e.g., with an integrated non-frangible hinge, with a contoured frangible score-line. The WFT may be configured to produce alternating access flaps upon full fracture and removal of the tab from the cover and base portions of the container. The alternating access flaps may comprise one access flap centered on the cover portion between two access flaps located on the base portion, e.g., as viewed from above. Alternatively, the alternating access flaps may comprise one access flap centered on the base portion between two access flaps located on the cover portion, e.g., as viewed from above.

An additional aspect of the invention provides a method of improving tamper security of a tamper evident container. The method may comprise the steps of incorporating an advanced tamper alert system which comprises a multi-color indication of tampering. In particular, the tamper evident component (e.g., frangible hinge, frangible tear strip, or WFT of the present invention) of the tamper evident container includes printed graphics that are a different color than the container regions adjacent to the tamper evident component, such that the tamper security of the tamper evident container is improved.

BRIEF DESCRIPTION OF THE FIGURES

Advantages of the present apparatus will be apparent from the following detailed description, which description should be considered in combination with the accompanying figures, which are not intended limit the scope of the invention in any way.

DETAILED DESCRIPTION OF THE INVENTION

Figure 1:
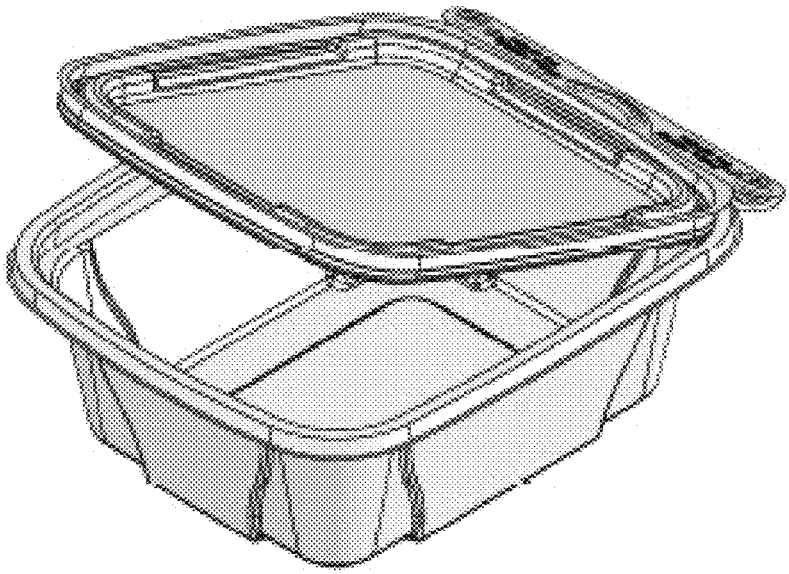
FIG. 1 is a top down perspective view of certain particular embodiments of the tamper evident containers of the present invention depicted in the open position with the designated front of the container directed to the left and towards the viewer.

The present invention is directed to containers and packaging that incorporate novel tamper evident features. The containers of the present invention incorporate a newly designed tamper evident linkages, i.e., wedged fracture tabs. This wedged fracture tab offers a more substantial "break away" feature with reduced risk of damage to the tamper evident component by the person filling the container that can result with known tamper evident components due to the structurally weak hinge points between cover and base that are also the point of break away. Further the present invention provides novel methods of improving tamper security of packages or containers by incorporating distinguishing printed graphics on the tamper evident component (e.g., frangible hinge, frangible tear strip, or wedged fracture tab of the present invention).

The present invention, including containers and methods of preparation will be described with reference to the following definitions that, for convenience, are set forth below. Unless otherwise specified, the below terms used herein are defined as follows:

I. Definitions

As used herein, the term "a," "an," "the" and similar terms used in the context of the present invention (especially in the context of the claims) are to be construed to cover both the singular and plural unless otherwise indicated herein or clearly contradicted by the context.

The term "asymmetric" as used in the language "asymmetrically frangible," describes the manner of fracture of the two sides of a frangible score line or perforation. In particular, it indicates that the two sides of the score line or perforation are not symmetrical, i.e., one side of the frangible score line or perforation is not identical (not a mirror image) to the other:

The language "closed position" describes the container when the peripheral locking flange assembly and the upper peripheral sealing edge of the base are reversibly interlocked.

The term "flange" is art-recognized and is used herein to describe a projecting flat rim or collar on an object, serving to strengthen an object's position on a structure upon which it rests, e.g., a lip or a rail structure. In certain embodiments of the containers of the present invention, the flange is part of a "peripheral locking flange assembly" which serves to contribute to the physical locking in place of the cover by interlocking with the upper peripheral sealing edge of the base, i.e., the flange is the outer edge of this assembly. In particular embodiments of the present invention, the flange comprises a truncated recessed flange (TRF).

The term "fracture" is used herein to describe the act of tearing of a frangible score line or perforation. Moreover, the language "full fracture" describes the complete tearing away of the two sides of a frangible score line or perforation.

The term "frangible" is used herein to describe the characteristic of a material that is intended to tear easily and cleanly at the point or line(s) made frangible. For example, a score line or perforation may be made frangible by the relative depth of the score, length, and/or number of the perforation designed or engineered to tear easily and cleanly. Alternatively, such score lines or perforations may be designed to be non-frangible by selecting a relative depth of the score and/or length of the perforation so as to not tear easily and/or cleanly; with an intention to act as something other than a tear point/line. For clarity, non-frangible score lines or perforations, given enough force or effort, may be torn, however are not torn easily, e.g., without a tool, nor cleanly torn, without producing distortion effects on the edges, in accordance with industry accepted standards of frangible score lines or perforations.

The term "imprinting" is art-recognized and is used herein to describe the act of either embossing or debossing a graphic image, e.g., textual, pictorial, or a combination of both. The product of imprinting is an imprint, which is either an embossed or debossed product. Embossing and debossing are techniques used to imprint impressed or depressed images onto paper. Embossing produces a raised design, e.g., text or graphic image, which is pressed into material from underneath. Embossing utilizes two dies (a male and female die). In particular embodiments, the imprinting may be printed upon, or the material may be printed upon before imprinting occurs.

The language "open position" describes the container when the peripheral locking flange assembly and the upper peripheral sealing edge of the base are not interlocked.

The term "substantially" is used herein in reference to the degree or extent of the term which it modifies, and that such extent is near but not exactly 100%, and industry accepted standards will assist in defining the quantitative aspects of how "near" 100% is defined. For example, as used in the term "substantially eliminate access," the term "substantially" would indicate that most access by a typical consumer utilizing expected access techniques would be eliminated.

The terms "tamper" or "tampering" are art-recognized and are used herein to describe the altering or adulteration (e.g., unintentional or deliberate) of a product, a package, or container.

The language "tamper evident" is art-recognized and is used herein to describe a container or feature of the container that makes tampering with the container easily detected, e.g., through visual inspection. In certain embodiments, in that such tamper evident features are designed to present difficulty in accessing the contents of the container (i.e., without being detected), the tamper evident containers may be considered tamper resistant.

The language "truncated recessed flange (TRF) assembly" as used herein, describes the flange located on the outer edge of the peripheral locking flange assembly on the cover portion of certain containers of the present invention comprising a truncated or shortened structure/appearance. Such language is used in contrast to the art-recognized outwardly extending peripheral flange located on the periphery of a cover characterized by its length, which extends outwardly over the lip presented by the base (e.g., and guarded from access by an upwardly projecting bead); as opposed to the TRL flange described herein, which is characterized by having substantially no extending overlap, e.g., no extending overlap, beyond the lip presented by the base. In certain embodiments, this TRF substantially eliminates, e.g., eliminates, access to the peripheral locking flange assembly, to prevent opening of the container without fracturing the WFT.

II. Tamper Evident Containers of the Invention

The present invention is directed to containers and packaging that incorporate novel tamper evident features. Such tamper evident elements are important for, among other things, deterring theft and preventing the loss of product and income for the seller, as well as instilling consumer confidence in the integrity of the contents within the container and confidence in the ability of the seller and/or manufacturer to provide and maintain quality goods.

As such, in one embodiment, the present invention provides a tamper evident container comprising:

a) a cover portion comprising a peripheral locking flange assembly;

b) a base portion comprising an upper peripheral sealing edge configured to substantially eliminate access to the peripheral locking flange assembly of the cover portion when the container is in the closed position; and c) a tamper evident linkage structure connecting the cover portion to the base portion comprising a wedged fracture tab (WFT), e.g., with an integrated non-frangible hinge, wherein the WFT is configured to produce access flaps upon full fracture and removal of the tab from the cover and base portions of the container.

Another embodiment of the present invention provides a tamper evident container comprising:

a) a cover portion comprising a peripheral locking flange assembly, wherein the peripheral locking flange assembly comprises a truncated recessed flange (TRF);

b) a base portion comprising an upper peripheral sealing edge configured to substantially eliminate, e.g., eliminate, access to the peripheral locking flange assembly of the cover portion when the container is in the closed position; and c) a tamper evident linkage structure connecting the cover portion to the base portion comprising an asymmetrically frangible wedged fracture tab (WFT), e.g., with an integrated non-frangible hinge with a contoured frangible scoreline, wherein the WFT is configured to produce alternating access flaps upon full fracture and removal of the tab from the cover and base portions of the container, and wherein the alternating access flaps comprise one access flap centered on the cover portion between two access flaps located on the base portion, e.g., as viewed from above.

The tamper evident containers of the present invention, are not limited by size or shape, i.e., the tamper containers may be any size or shape. In certain embodiments, the shape of the tamper evident containers of the present invention may be selected from the group consisting of square, rectangle, round, elliptical, triangular, pentagon, hexagon, octagon, oval, quatrefoil, and curvilinear triangle. In certain embodiments, these shapes may be formed by arced lines (as compared with straight lines). In particular embodiments, the lower perimeter of the base portion is formed with straight lines, and the upper perimeter of the base portion (e.g., where the cover portion is placed to interlock with the base portion) is formed with arced lines. In addition, the shapes may contain arced vertices, which creates an arced edge lock at the corners of the shaped container structure, and which improves leak resistance.

In certain embodiments of the present invention, the volume capacity is selected from 2 US fluid ounces to 64 US fluid ounces (e.g., wherein the volume size measurements are based on an industry standard "fill line" in fluid ounces). In certain specific embodiments, the dimensions of the containers range from 0.5 inches by 1.5 inches by 1.5 inches to 6.0 inches by 14.0 inches by 14.0 inches.

In a particular embodiment of the invention, the tamper evident container is a rectangle shape, e.g., formed with arced lines, with a volume capacity of 12 US fluid ounces. In another particular embodiment of the invention, the tamper evident container is a rectangle shape, e.g., formed with arced lines, with a volume capacity of 24 US fluid ounces In certain embodiments of the present invention, the container is comprised of plastic, e.g., clear/see-through or opaque plastic.

In certain embodiments of the present invention, the tamper evident container may comprise an imprint in any location or component of the container such that it does not affect the ability of the container to perform its intended function. In particular embodiments, the imprinting may be printed upon, or the material may be printed upon before imprinting occurs.

In certain embodiments of the present invention, the container further comprises printed graphics, e.g., distortion control printed graphics. In particular embodiments, the printed graphics comprise 2 or more colors. In particular embodiments, the printed graphics comprise 3 or more colors. In certain embodiments, the printing may be on the upper surface (product facing) of the container, the lower surface (underside that faces away from the product) of the container, or a combination of both.

In certain embodiments of the present invention, the distortion control printed graphics serve as an advanced tamper alert comprising a multi-color indication of tampering, wherein the wedged fracture tab (WFT) comprises printing of a different color than the container regions adjacent to the WFT, e.g., at least the cover portion access flaps, e.g., at least the cover portion periphery (which includes the access flaps). In particular embodiments, the WFT may be completely or partially printed, e.g., by a mark or indication, e.g., on the fracture enhancement buttons. In a specific embodiment, the mark or indication printed on each side of the hinge in the WFT prior to closing the container, together, form a unique shape that can be visualized upon closure of the container (i.e., folding of the hinge on the WFT that occurs upon such closure). In a specific embodiment, the WFT may be completely or partially printed upon, while the container regions adjacent to the WFT contain no printing.

In certain embodiments of the present invention, the container comprises an enhanced security locking feature that assists in ensuring structural integrity of the cover portion at one or more sides to prevent the cover from flexing in any manner that would allow access to the contents of the container without removing the WFT. The enhanced security locking feature comprises a male protrusion supporting post centrally located on the inner sidewall of one or more sides of the base portion, e.g., of sufficient size and shape, which is engineered to provide additional support to the cover, and rest within a receiving recess of the cover in the closed position (e.g., adjacent to the peripheral locking flange assembly, e.g., as shown on the base portion of the container of FIG. 5). In a specific embodiment, the post is a button engineered to reversibly engage and interlock with the cover portion in the recess located on the cover. In particular embodiments, the cover portion recess located internally adjacent to the peripheral locking flange assembly is modified to receive the male protrusion button, e.g., by flattening the recess location.

In particular embodiments, and without intending to be limiting, such enhanced security locking feature may be present on containers that reach a size where pressing the middle of the cover portion can result in sufficient enough corresponding separation between the upper sealing edge and the peripheral locking flange assembly as to afford unauthorized access to the contents of the container without removing the WFT. In a particular embodiment, only one side of the container possess this enhanced security locking feature. In particular embodiments, two or more sides may possess this enhanced security locking feature.

Moreover, in certain embodiments, the tamper evident containers of the present invention may incorporate additional design elements that do not significantly inhibit or prevent the features of the containers explicitly described herein.

A. Cover Portion

The cover portion of the tamper evident containers of the present invention comprises a peripheral locking flange assembly. This peripheral locking flange assembly comprises a flange, i.e., the flange is the outer edge of this assembly, and a locking structure that is designed/constructed to reversibly interlock with the upper peripheral sealing edge of the base portion that is engineered with a negative draft angle, or in-cut, extending substantially about the perimeter of the base portion. The circumferential recess created by this negative draft angle matches the shape of the locking structure of the peripheral locking flange assembly to assist in reversibly securing the cover to the base. In certain embodiments, a chamfer edge design of the cover portion peripheral locking flange assembly affords an ease of closing the cover into a secure interlocked position.

In certain embodiments of the present invention, the peripheral locking flange assembly comprises an outwardly extending peripheral flange.

In certain embodiments of the present invention, the peripheral locking flange assembly comprises a truncated recessed flange (TRF).

In certain embodiments of the invention, the cover portion further comprises a stacking ridge configured to allow a second container to be stacked on top of the tamper evident container.

In certain embodiments of the invention, the cover portion further comprises an optimized surface, e.g., sidewall or top surface, engineered for maximum labeling compatibility.

In certain embodiments of the present invention, the cover portion further comprises printing, e.g., distortion control printed graphics. Distortion control printing, or distortion printing is the process of printing a distorted version of an image onto a sheet of plastic and systematically vacuum forming the sheet on a mold so that specific areas of the printed image appear in intended corresponding areas of the resulting three-dimensional finished product. In particular embodiments, the printed graphics comprise 2 or more colors. In particular embodiments, the printed graphics comprise 3 or more colors. In certain embodiments, the printing may be on the upper surface (product facing) of the container, the lower surface (underside that faces away from the product) of the container, or a combination of both.

In certain embodiments of the invention, the cover portion is comprised of plastic, e.g., clear/see-through or opaque plastic.

B. Base Portion

The base portion of the tamper evident containers of the present invention serve as the lower portion of the container, i.e., the portion of the container on which the items stored in the container are placed, and with which the cover portion interlocks. The base portion comprises an upper peripheral sealing edge configured to substantially eliminate access to the peripheral locking flange of the cover portion when the container is in the closed position. Furthermore, the upper peripheral sealing edge of the base portion is designed/constructed to reversibly interlock with the peripheral locking flange. The upper peripheral sealing edge of the base portion is engineered with a negative draft angle, or in-cut, extending substantially about the perimeter of the base portion. The circumferential recess created by this negative draft angle matches the shape of the locking structure of the peripheral locking flange assembly to assist in reversibly securing the cover to the base. In certain embodiments, a chamfer edge design of the upper edge of the peripheral sealing edge affords an ease of closing the cover into a secure interlocked position.

In certain embodiments of the present invention, the base portion shape comprises shapes arced vertices, which create one or more arced edge locks at the corners of the shaped base portion. In particular embodiments, the arced edge lock improves leak resistance when the cover and base portions are interlocked.

In certain embodiments of the invention, the base portion further comprises a return wall engineered to improve structural integrity, e.g., present along the entire outer periphery of the base portion.

In certain embodiments of the invention, the base portion further comprises side ribs, e.g., in the sidewall, engineered to add structural strength and stiffness to the tamper evident container. An example of a sigmoid type rib structure is shown in the examples in FIGS. 1-9.

In certain embodiments of the invention, the base portion further comprises at least one chamfered corner, e.g., at the bottom perimeter of the base portion, engineered to improve material distribution.

In certain embodiments of the invention, the base portion further comprises printing, e.g., distortion control printed graphics. In particular embodiments, the printed graphics comprise 2 or more colors. In particular embodiments, the printed graphics comprise 3 or more colors. In certain embodiments, the printing may be on the upper surface (product facing) of the container, the lower surface (underside that faces away from the product) of the container, or a combination of both.

In certain embodiments of the invention, the base portion is comprised of plastic, e.g., clear/see-through or opaque plastic.

C. Tamper Evident Linkage Structure

The containers of the present invention comprise a tamper evident linkage structure comprising a tamper evident component connecting to the cover and base portions through linking flaps. In certain embodiments, the tamper evident component comprises a wedged fracture tab (WFT), e.g., with an integrated non-frangible hinge. In particular, the WFT of the present invention is engineered as a two layer bi-folded hinged tear tab (as compared to the known single layer tear strips); wherein two sides of a folded hinge are each attached to one of the cover or base portions in a V-shaped wedge through a linking flap. In particular, the WFT comprises two score lines located on each side of the folded hinge, i.e., one closer to the base portion and one closer to the cover portion, configured to allow the fracture of both lines at nearly the same time and the removal of a V-shaped bi-folded wedge; and leaving the linking flaps remaining as access flaps on the cover and base portions that are useful for opening and reopening the container after fracture at the score lines. Such design is a more substantial "break away" feature with reduced risk of damage to the tamper evident component by the person/machine filling the container that can result with known tamper evident components (i.e., prior break way tear strip or tear line designs) due to their structurally weak hinge points between cover and base that are also the point of break away. The bi-folded tab is more easily visualized for evidence of tampering and more easily gripped and torn (or fractured) by the user attempting to open a closed container possessing consumer products. Moreover, in certain embodiments, the WFT is configured to produce access flaps, e.g., alternating linking flaps, upon full fracture and removal of the tab from the cover and base portions of the container.

In certain embodiments of the invention, the wedged fracture tab (WFT) is asymmetrically frangible. In certain embodiments, the asymmetrically frangible wedged fracture tab (WFT) is configured with a contoured frangible scoreline. In certain embodiments, the asymmetrically frangible wedged fracture tab (WFT) is configured to produce alternating access flaps upon full fracture and removal of the tab from the cover and base portions of the container. These access flaps are created by the residual of the WFT after the wedged fracture tab has been removed, which produce suitable overlaps or flaps that afford the user repeated access to the contents of the container after the container has been closed and locked, e.g., interlocked.

In one particular embodiment, the alternating access flaps comprise one access flap centered on the base portion between two access flaps located on the cover portion, e.g., as viewed from above. In another particular embodiment, the alternating access flaps comprise one access flap centered on the cover portion between two access flaps located on the base portion, e.g., as viewed from above.

In certain embodiments of the invention, the wedged fracture tab (WFT) further comprises imprinting on the area of the WFT to be removed upon full fracture from the cover and base portions of the container. Alternatively, in certain embodiments of the invention, the access tabs further comprise imprinting, e.g., wherein the imprinting is located on the area of the container that remains upon full fracture and removal of the WFT from the cover and base portions of the container.

In certain embodiments of the invention, at least one of the access flaps is configured with a grip ridge.

In certain embodiments of the invention, the wedged fracture tab (WFT) further comprises fracture enhancement buttons, e.g., comprising a gripping feature on the tab that enhances the tearing of the WFT. These fracture enhancement buttons afford the user/consumer a greater degree of grip in order to assist in the tearing or fracture of the WFT.

II. Methods of the Invention

A. Methods of Preparation

It should be readily understood by the ordinarily skilled artisan in light of the disclosure provided herein that a container constructed in accordance with the present invention can be manufactured in a variety of shapes and sizes, and can be formed from resins or plastic materials such as polyethylene, polypropylene, polyvinyl chloride or polyethylene terephthalate ("PETE"), as well as other suitable materials or combinations thereof. Moreover, the forming process can also vary to include methods such as thermoforming, injection molding or blow molding. In certain embodiments, the container can be transparent, translucent, or opaque, and may be colored in any instance.

In certain embodiments, and by no means intended to limit the containers of the present invention in terms of design or construction, e.g., material composition, the tamper evident containers of the present invention are prepared by using standard thermoforming techniques/technology, in conjunction with a mold constructed to produce a tamper evident container of the present invention.

In general, thermoforming is a manufacturing process where a plastic sheet is heated to a forming-temperature as to be pliable, formed with a mold into a specific shape, and trimmed to create a usable product. The sheet is heated in an oven to a high-enough temperature that it can be stretched into or onto a mold and cooled to a finished shape. In certain embodiments, the process may be automated, for example, by using large production machines to heat and form the plastic sheet, as well as trim the formed parts from the sheet using a continuous process.

In particular embodiments, plastic sheet may be fed from a roll or from an extruder into a set of indexing chains that incorporate pins, or spikes, which pierce the sheet and transport it through an oven for heating to forming-temperature. The heated sheet then moves through another station, i.e., a form station, where, with the application of vacuum, a mold and pressure-box close on the sheet to produce the desired product, e.g., the tamper evident containers of the present invention. The sheet containing the formed product is then trimmed, e.g., with a die that cuts the product from the remaining sheet web.

In certain embodiments, the molds used in these processes may be comprised of wood, composite, or aluminum.

It should be further understood that part of the thermoform process includes molds that create the score lines or perforations. The ordinarily skilled artisan understand the processes that make these frangible or non-frangible, which are well known in the art.

B. Methods of Improving Tamper Security

In addition, the present invention provides novel methods of improving tamper security of packages or containers by incorporating distinguishing printed graphics on the tamper evident component (e.g., frangible hinge, frangible tear strip, or wedge of the wedged fracture tab) of the present invention.

As such, another embodiment of the present invention provides a method of improving tamper security of a tamper evident container comprising the steps of incorporating an advanced tamper alert system which comprises a multi-color indication of tampering, wherein the tamper evident component (e.g., frangible hinge, frangible tear strip, or WFT of the present invention) of the tamper evident container includes printed graphics that are a different color than the container regions adjacent to the tamper evident component, such that the tamper security of the tamper evident container is improved.

In certain embodiments, the printing may be on the upper surface (product facing) of the container, the lower surface (underside that faces away from the product) of the container, or a combination of both.

With respect to the step of "incorporating," such term is used to describe either (1) printing on the material, e.g., plastic, before thermoforming through distortion control printed graphics, or (2) obtaining one or more components of the tamper evident container after thermoforming and printing or spraying the color directly onto the plastic.

For example, in a particular embodiment, the tamper evident component, e.g., tear strip or WFT, is red, and is a different color from the regions adjacent to the tamper evident component, e.g., the access tabs of the WFT.

In certain embodiments, wherein the tamper evident component is a wedged fracture tab, the wedged fracture tab (WFT) may comprise printing of a different color than the container regions adjacent to the WFT, e.g., at least the cover portion access flaps, e.g., at least the cover portion periphery (which includes the access flaps). In particular embodiments, the WFT may be completely or partially printed, e.g., by a mark or indication, e.g., on the fracture enhancement buttons. In a specific embodiment, the mark or indication printed on each side of the hinge in the WFT prior to closing the container, together, form a unique shape that can be visualized upon closure of the container (i.e., folding of the hinge on the WFT that occurs upon such closure). In a specific embodiment, the WFT may be completely or partially printed upon, while the container regions adjacent to the WFT contain no printing.

IV. Design Aspects of the Invention

Independent of the utility related to the containers of the present invention, the ornamental appearance of any novel design provided herein is intended to be part of this invention, for example, each of the perspective views in FIGS. 1 through 9, which may form an independent or combined ornamental appearance of the containers described herein.

Accordingly, one embodiment of the present invention provide an ornamental design for a tamper evident container as shown and described.

EXEMPLIFICATION

Having thus described the invention in general terms, reference will now be made to the accompanying drawings of exemplary embodiments, which are not necessarily drawn to scale, and which are not intended to be limiting in any way.

In this respect, it is to be understood that the invention is not limited in its application to the details of construction and to the arrangements of the components set forth in the following description or illustrated in the Figures. The invention is capable of other embodiments and of being practiced and carried out in various ways. Also, it is to be understood that the phraseology and terminology employed herein are for the purpose of description and should not be regarded as limiting. For convenience of reference, the designated front of the container is that side of the container that is opposite the WFT.

FIG. 1 is a top down illustrative perspective view of a particular fabricated tamper evident container of the present invention depicted in the open position with the designated front of the container directed to the left and towards the viewer.

Figure 2:
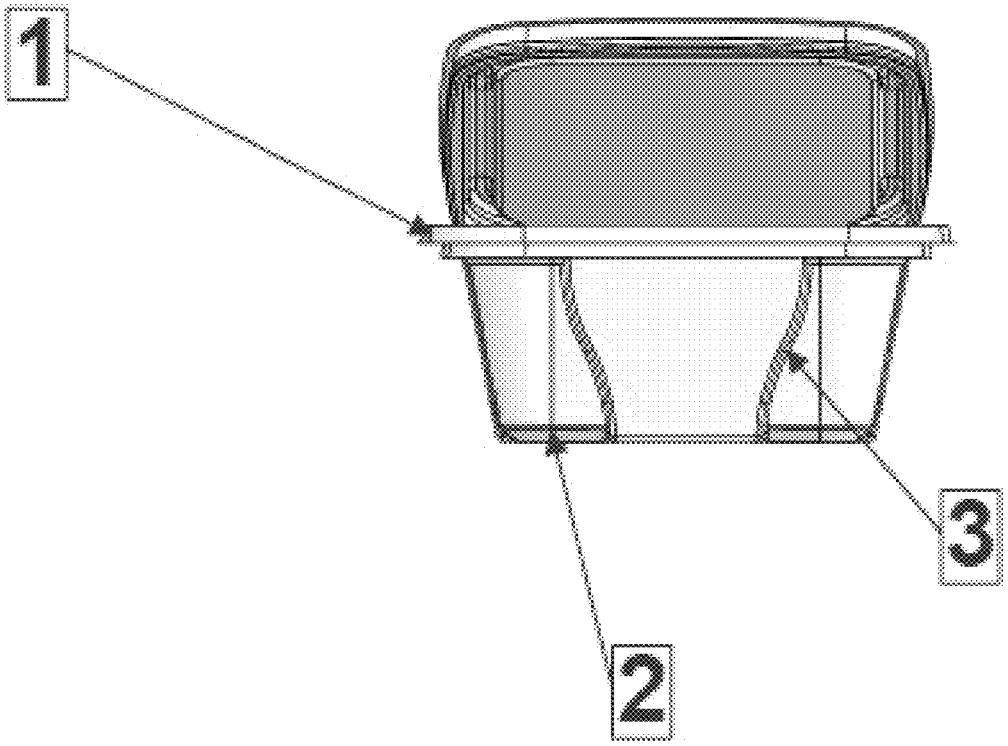
FIG. 2 is a side perspective view of certain particular embodiments of the tamper evident containers of the present invention depicted in the open position with the designated front of the container directed directly towards the viewer.

FIG. 2, which is a side perspective view of the container of FIG. 1, is depicted in the open position with the designated front of the container directed directly towards the viewer. Return wall 1 shown in this perspective was engineered to improve structural integrity of the container, and is present along the entire outer periphery of the base portion. Chamfered corner 2 was designed to improve overall integrity and allowed for reliable material distribution, and was present in each of the 4 corners of this rectangular container. Ribs 3 were incorporated into the side wall of the container to improve structural integrity, are present as a sigmoid type rib structure mirror pair on each side wall of the container.

Figure 3:
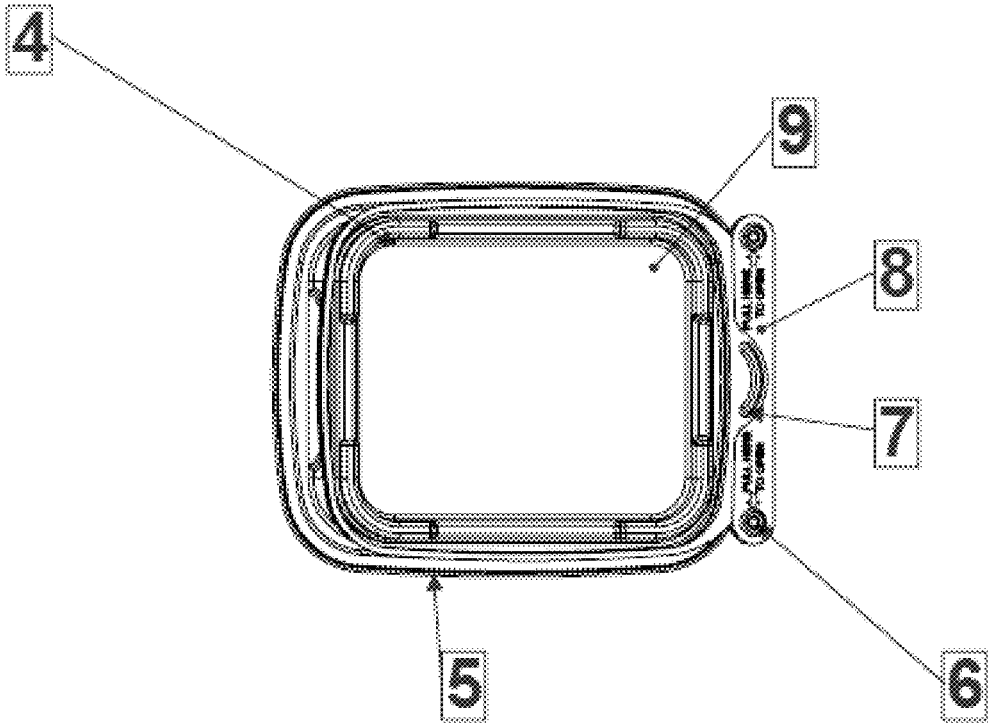
FIG. 3 is a directly top down perspective view of certain particular embodiments of the tamper evident containers of the present invention depicted in the open position with the designated front of the container directed directly towards the left.

FIG. 3, which is a directly top down perspective view of FIG. 1, is depicted in the open position with the designated front of the container directed directly towards the left. Lid 4 was designed to allow confident multiple container stacking. The outer footprint 5 of the container was minimized in size to maximize use of available retail real estate. Fracture enhancement buttons 6 afford a gripping feature and simplify the action of tearing. Access flap 7 is a tab that allows the container to be open and closed after the wedged fracture tab (WFT) 8 is removed, affording the ability to reuse the container; and is created by the act of removing WFT 8. Access flap 7 was configured with a grip ridge. WFT 8 contained imprinted graphics/text, and may be discarded once removed. Branding area 9 was located on the cover portion and is maximized by design to maximize the branding area.

Figure 4:
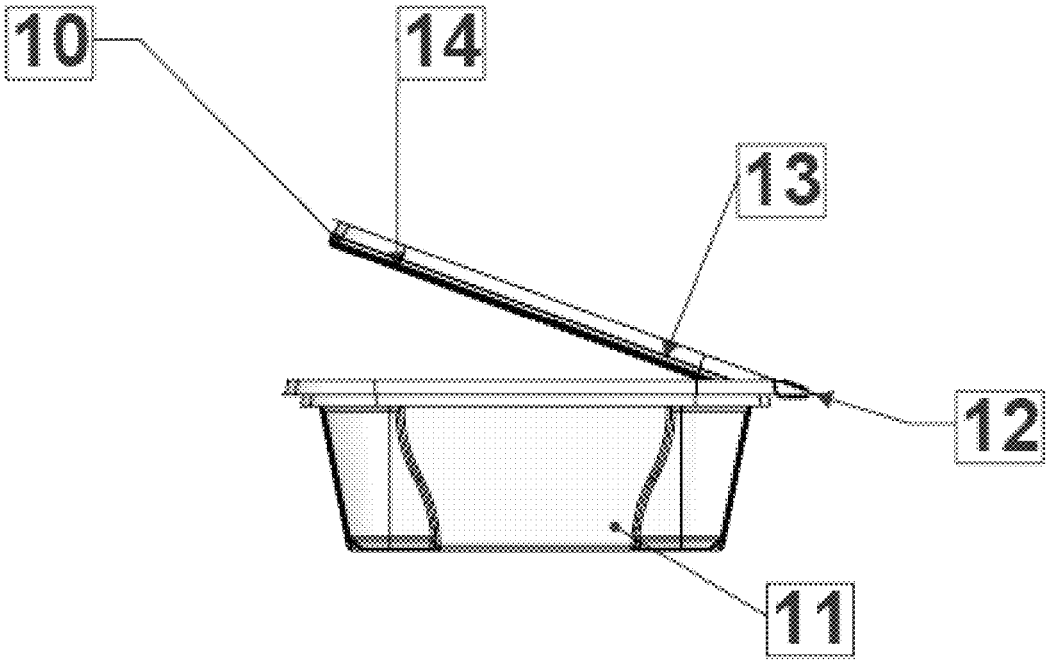
FIG. 4 is a side perspective view of certain particular embodiments of the tamper evident containers of the present invention depicted in the open position with the designated front of the container directed directly towards the left.

FIG. 4, which is a side perspective view of the container of FIG. 1, is depicted in the open position with the designated front of the container directed directly towards the left. Arced edge lock 10 at the corners of the shaped container improves leak resistance. Sidewall 11 is presented as a flat surface design for branding convenience. Non-frangible hinge 12 is perforated for ease of closing the cover and locking cover portion to base portion. Truncated peripheral locking flange assembly 13 is designed to securely and reversibly interlock with the upper peripheral sealing edge of the base portion; as to ensure container cannot be opened until WFT 8 is removed. Chamfered edge 14 is designed to allow ease of closing the cover portion, i.e., interlocking the cover portion with the base portion.

Figure 5:
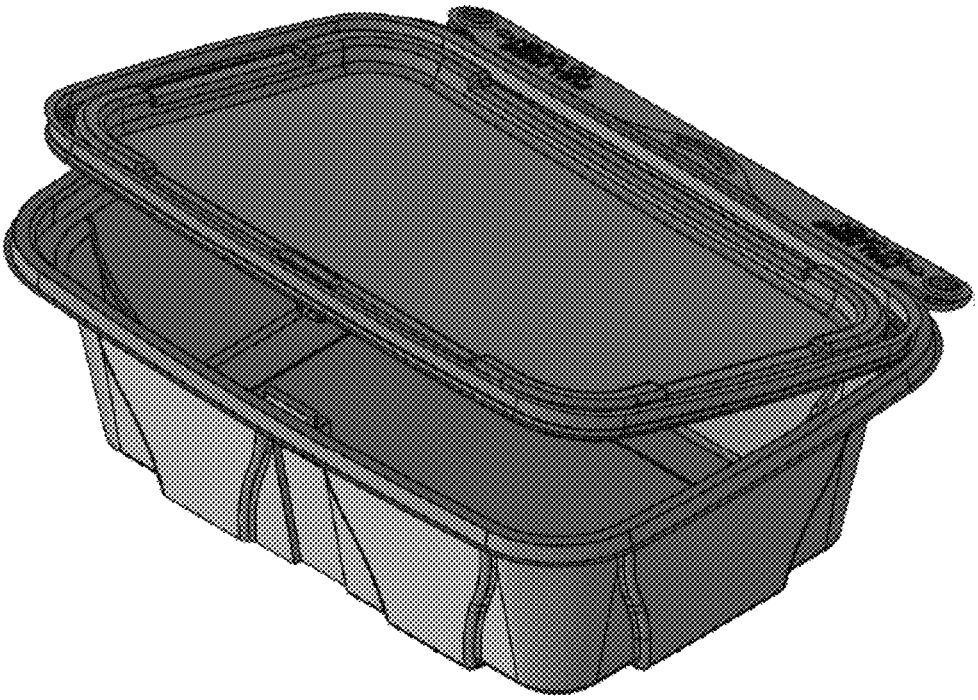
FIG. 5 is a top down perspective view of certain particular embodiments of the tamper evident containers of the present invention depicted in the open position with the designated front of the container directed to the left and towards the viewer; such embodiment additionally depicts an enhanced security locking feature centrally positioned on the front of the container (male component on the base portion and female receiving position on the cover portion)

FIG. 5 is a top down illustrative perspective view of a particular fabricated tamper evident container of the present invention depicted in the open position with the designated front of the container directed to the left and towards the viewer; such embodiment additionally depicts an enhanced security locking feature centrally positioned on the front of the container (male protrusion supporting post centrally located on the inner sidewall of one or more sides of the base portion, e.g., of sufficient size and shape, which is engineered to provide additional support to the cover, and rest within a receiving recess of the cover in the closed position). The particular embodiment described depicts a larger container as compared with FIG. 1.

Figure 6:
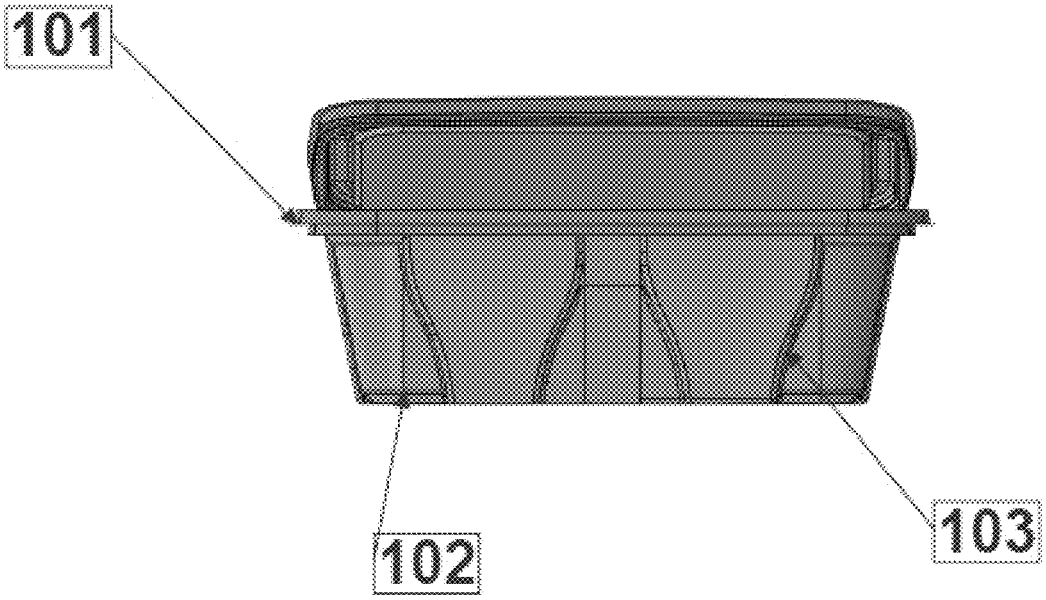
FIG. 6 is a side perspective view of certain particular embodiments of the tamper evident containers of the present invention depicted in the open position with the designated front of the container directed directly towards the viewer; such embodiment additionally depicts an enhanced security locking feature centrally positioned on the front of the container.

FIG. 6, which is a side perspective view of the container of FIG. 5, is depicted in the open position with the designated front of the container directed directly towards the viewer. Return wall 101 shown in this perspective was engineered to improve structural integrity of the container, and is present along the entire outer periphery of the base portion. Chamfered corner 102 was designed to improve overall integrity and allowed for reliable material distribution, and was present in each of the 4 corners of this rectangular container. Ribs 103 were incorporated into the side wall of the container to improve structural integrity, and were present as a sigmoid type rib structure mirror pair on each side wall of the container. Due to the larger side indicated, two mirror pairs of ribs are shown on the longer side.

Figure 7:
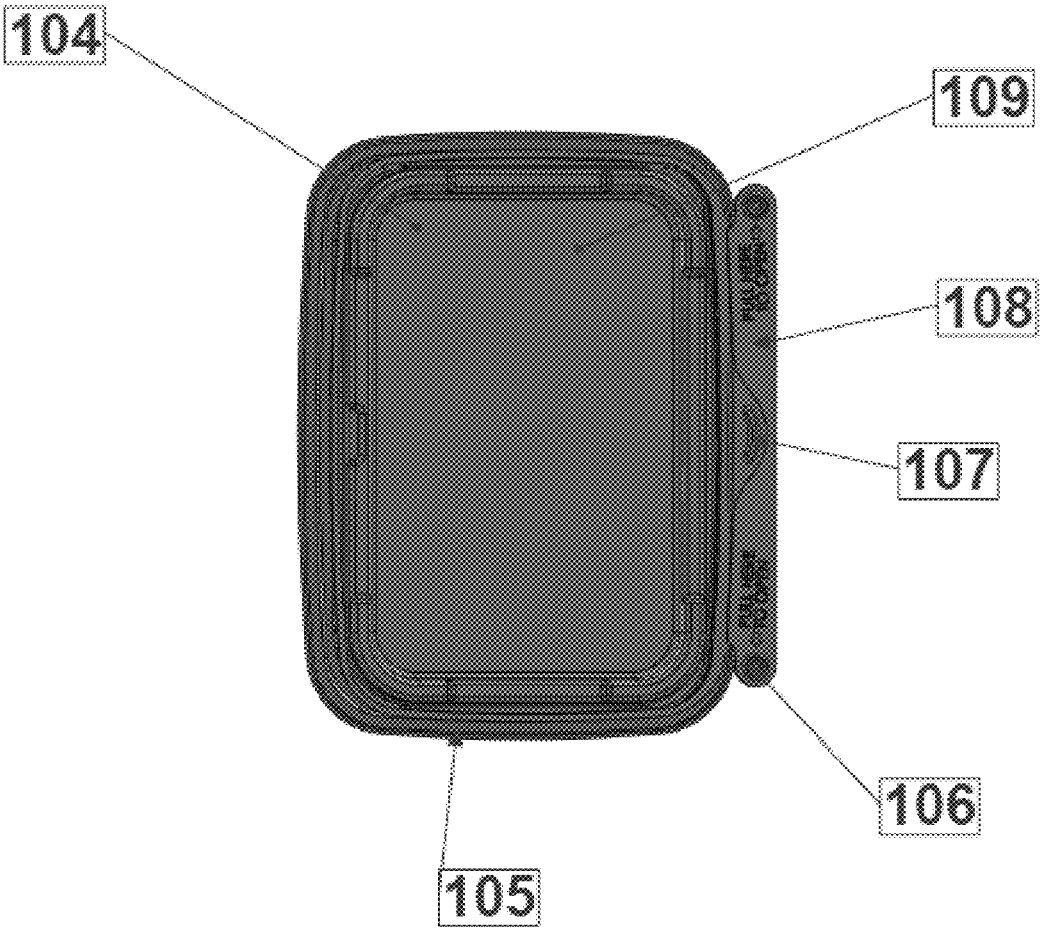
FIG. 7 is a directly top down perspective view of certain particular embodiments of the tamper evident containers of the present invention depicted in the open position with the designated front of the container directed directly towards the left; such embodiment additionally depicts an enhanced security locking feature centrally positioned on the front of the container.

FIG. 7, which is a directly top down perspective view of FIG. 5, is depicted in the open position with the designated front of the container directed directly towards the left. Lid 104 is designed to allow confident multiple container stacking. The outer footprint 105 of the container was minimized in size to maximize use of available retail real estate. Fracture enhancement buttons 106 afforded a gripping feature and simplified the action of tearing. Access flap 107 is a tab that allows the container to be open and closed after the wedged fracture tab (WFT) 108 is removed, affording the ability to reuse the container; and is created by the act of removing WFT 108. Access flap 107 was configured with a grip ridge. WFT 108 contained imprinted graphics/text, and may be discarded once removed. Branding area 109 was located on the cover portion and is maximized by design to maximize the branding area.

Figure 8:
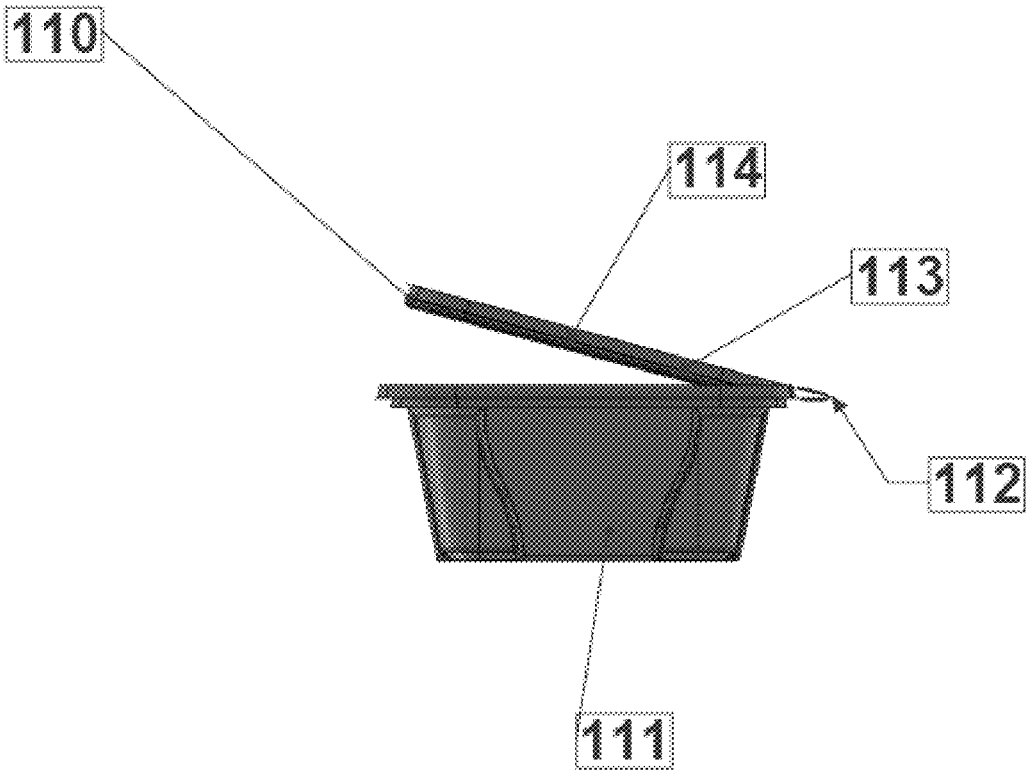
FIG. 8 is a side perspective view of certain particular embodiments of the tamper evident containers of the present invention depicted in the open position with the designated front of the container directed directly towards the left; such embodiment additionally depicts an enhanced security locking feature centrally positioned on the front of the container.

FIG. 8, which is a side perspective view of the container of FIG. 5, is depicted in the open position with the designated front of the container directed directly towards the left. Arced edge lock 110 at the corners of the shaped container improves leak resistance. Sidewall 111 is presented as a flat surface design for branding convenience. Non-frangible hinge 112 is perforated for ease of closing the cover and locking cover portion to base portion. Truncated peripheral locking flange assembly 113 is designed to securely and reversibly interlock with the upper peripheral sealing edge of the base portion; as to ensure container cannot be opened until WFT 108 is removed. Chamfered edge 114 is designed to allow ease of closing the cover portion, i.e., interlocking the cover portion with the base portion.

Figure 9:
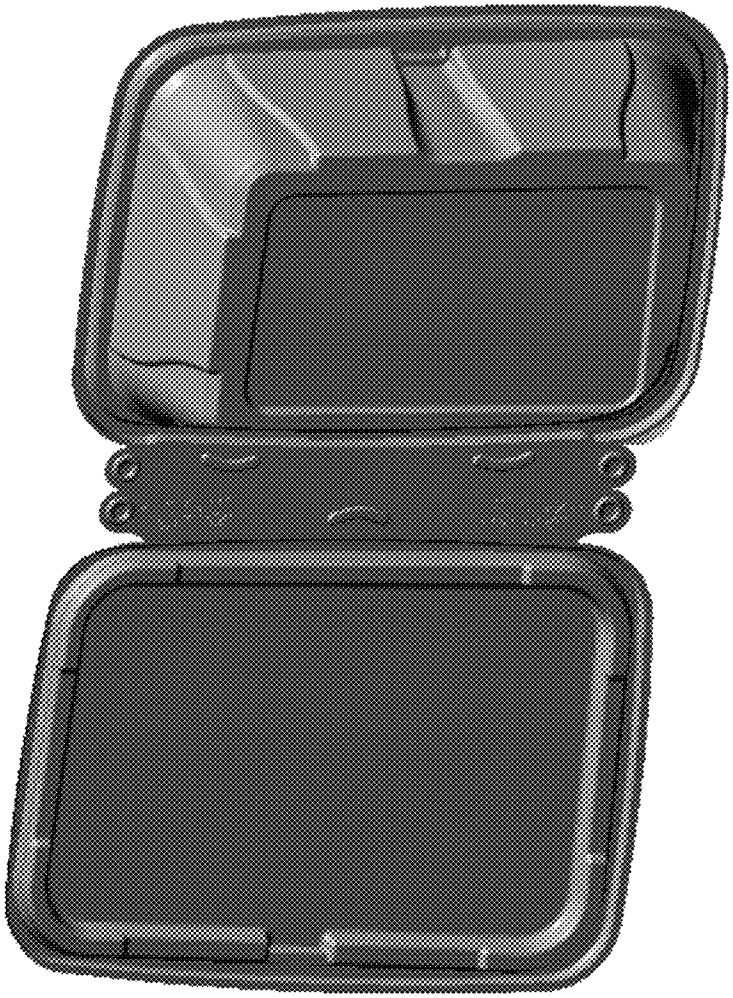
FIG. 9 is a top down perspective view of certain particular embodiments of the tamper evident containers of the present invention depicted in the open position with the designated front of the container directed to the left and towards the viewer; such embodiment additionally depicts an enhanced security locking feature centrally positioned on the front of the container (male component on the base portion and female receiving position on the cover portion), wherein the structurally supportive vertical ribs have been removed and the structural support of the male component is adjusted (i.e., widened) to draw structural support from the sigmoid type rib structure shown in FIG. 5.

FIG. 9 is a top down illustrative perspective view of a second particular fabricated tamper evident container of the present invention depicted in the open position with the designated front of the container directed to the left and towards the viewer; such embodiment additionally depicts an enhanced security locking feature centrally positioned on the front of the container. This particular embodiment described depicts a container as compared with FIG. 5, wherein the male protrusion supporting post centrally located on the inner sidewall draws structural support from the sigmoid ribbing rather than additional vertical ribs shown in FIG. 5.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, numerous equivalents to the specific procedures described herein. Such equivalents are considered to be within the scope of this invention and are covered by the following claims. Moreover, any numerical or alphabetical ranges provided herein are intended to include both the upper and lower value of those ranges. In addition, any listing or grouping is intended, at least in one embodiment, to represent a shorthand or convenient manner of listing independent embodiments; as such, each member of the list should be considered a separate embodiment.

What is claimed is:

1. A tamper evident container comprising:

a) a cover portion comprising a peripheral locking flange assembly;

b) a base portion comprising an upper peripheral sealing edge configured to substantially eliminate access to the peripheral locking flange assembly of the cover portion when the container is in the closed position; and c) a tamper evident linkage structure connecting the cover portion to the base portion comprising an asymmetrically frangible wedged fracture tab (WFT) wherein the wedged fracture tab is engineered as a two layer bi-folded hinged tear tab wherein two sides of a folded hinge are each attached to one of the cover or base portions in a V-shaped wedge through a linking flap configured to produce alternating access flaps upon full fracture and removal of the tab from the cover and base portions of the container, and wherein the wedged fracture tab (WFT) comprises an integrated non-frangible hinge.

2. The tamper evident container of claim 1, wherein the peripheral locking flange assembly comprises an outwardly extending peripheral flange.

3. The tamper evident container of claim 1; wherein the peripheral locking flange assembly comprises a truncated recessed flange (TRF).

4. The tamper evident container of claim 1, wherein the asymmetrically frangible wedged fracture tab (WFT) is configured with a contoured frangible score-fine.

5. The tamper evident container of claim 1, wherein at lent one of the access flaps is configured with a grip ridge.

6. The tamper evident container of claim 1, further comprising an arced edge lock.

7. The tamper evident container of claim 1, wherein the cover portion further comprises a stacking ridge configured to allow a second container to be stacked on top of the tamper evident container.

8. The tamper evident container of claim 1, wherein the base portion further comprises side ribs engineered to add structural strength and stiffness to the tamper evident container.

9. The tamper evident container of claim 1, wherein the base portion further comprises at least one chamfered corner engineered to improve material distribution.

10. The tamper evident container of claim 1, wherein the wedged fracture tab (WFT) further comprises fracture enhancement buttons.

11. The tamper evident container of claim 1, wherein the shape of the container is selected from the group consisting of square, rectangle, round, elliptical, triangular, pentagon, hexagon, octagon, oval, quatrefoil, and curvilinear triangle.

12. The tamper evident container of claim 1, wherein the tamper evident container is comprised of plastic.

13. The tamper evident container of claim 1, wherein the cover portion further comprises distortion control printed graphics.

14. The tamper evident container of claim 13, wherein the printed graphics comprise 2 or more colors.

15. The tamper evident container of claim 1, wherein the base portion further comprises distortion control printed graphics.

16. A tamper evident container comprising:

a) a cover portion comprising a peripheral locking flange assembly, wherein the peripheral locking flange assembly comprises a truncated recessed flange (TRF);

b) a base portion comprising an upper peripheral sealing edge configured to substantially eliminate access to the peripheral locking flange assembly of the cover portion when the container is in the closed position; and c) a tamper evident linkage structure connecting the cover portion to the base portion comprising an asymmetrically frangible wedged fracture tab (WFT) with integrated non-frangible hinge with a contoured frangible score-line, wherein the WFT is engineered as a two layer bi-folded hinged tear tab wherein two sides of a folded hinge are each attached to one of the cover or base portions in a V-shaped wedge through a linking flap configured to produce alternating access flaps upon full fracture and removal of the tab from the cover and base portions of the container, and wherein the alternating access flaps comprise one access flap centered on the cover portion between two access flaps located on the base portion.

* * * * *